United States Patent [19]

Ahn

[11] Patent Number: 5,046,741

[45] Date of Patent: Sep. 10, 1991

[54] GOLF MAT

[76] Inventor: Markham D. Ahn, 8115 Redlands St. #107, Playa del Rey, Calif. 90293

[21] Appl. No.: 509,701

[22] Filed: Apr. 16, 1990

[51] Int. Cl.[5] ..... A63B 69/36

[52] U.S. Cl. ..... 273/195 A; 273/195 B

[58] Field of Search ..... 273/195 A, 195 R, 195 B, 273/183 A, 176 H, 176 J, 187 R, 187 A, 187 B

[56] References Cited

U.S. PATENT DOCUMENTS

| | | | |
|---|---|---|---|
| 3,529,831 | 9/1970 | Rogers | 273/195 A |
| 3,578,333 | 5/1971 | Elesh | 273/195 A |
| 3,693,979 | 9/1972 | Koett | 273/195 A |
| 3,869,127 | 3/1975 | Kohori | 273/195 A |
| 3,869,128 | 3/1975 | Ohashi | 273/195 A |

*Primary Examiner*—George J. Marlo
*Attorney, Agent, or Firm*—Benman & Collins

[57] ABSTRACT

A golf mat which includes a playing surface supported at a nonzero angle with respect to the ground. In specific embodiments, the playing surface includes artificial turf with an irregular contour. A tee is provided for maintaining a golf ball in an elevated position. The support of the playing surface is provided by a base which lies on the ground and a pivotal supporting apparatus supported by said base and attached to the playing surface. The pivotal supporting apparatus may be adapted for rotary engagement with the base, adapted for maintaining the playing surface in a fixed nonzero angle with respect to the base, and/or adapted for adjusting the elevation between the base and the playing surface. In another embodiment, the mat includes a wedge-shaped base 30 inches in diameter with a thickness ranging from ¼ inch at its low end to 3 inches at a diametrically opposite end,

1 Claim, 5 Drawing Sheets

FIG. 1
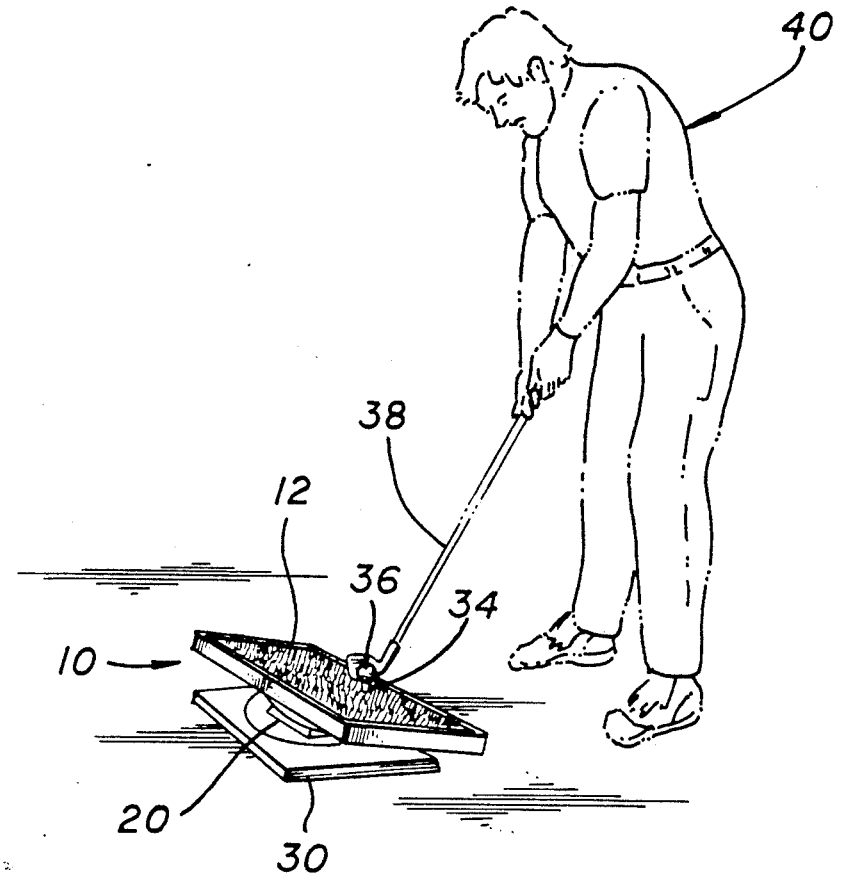
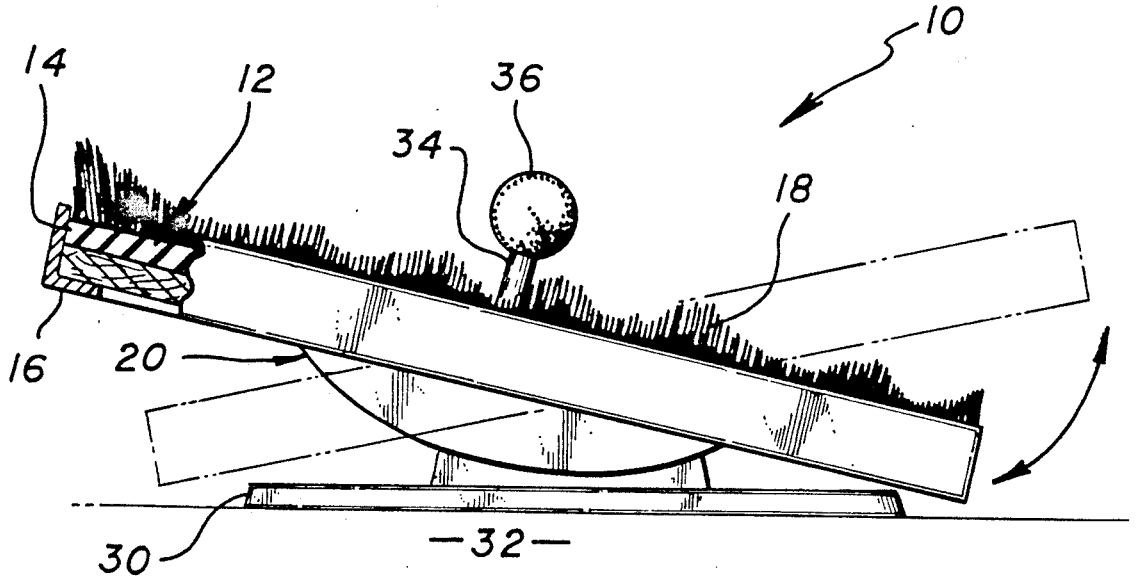
FIG. 2

FIG. 3
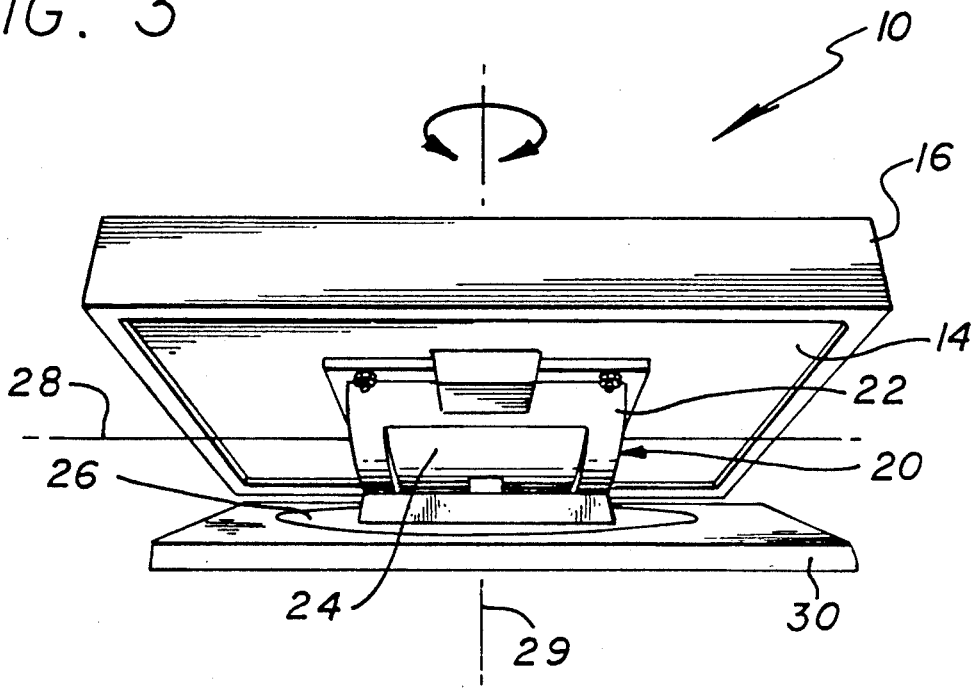
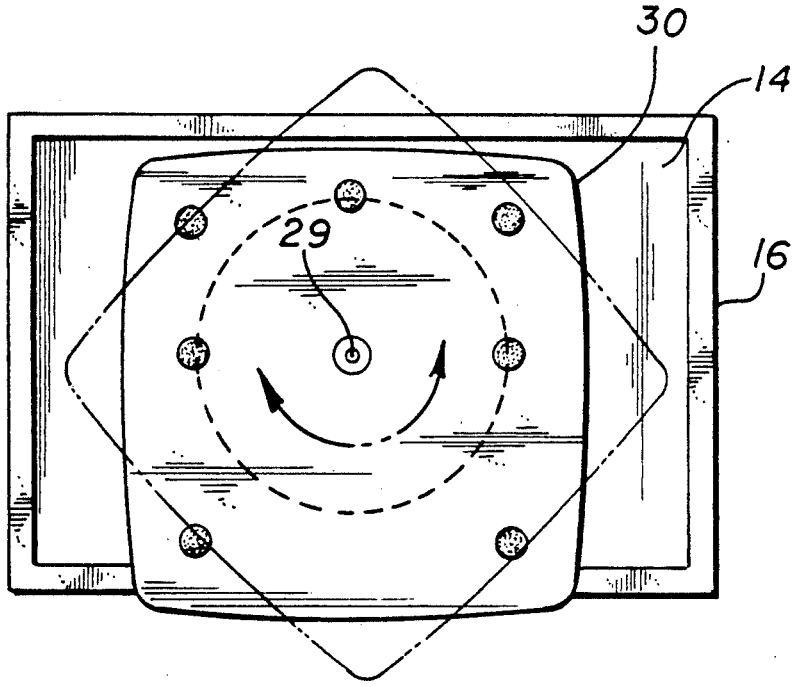
FIG. 4

FIG. 5
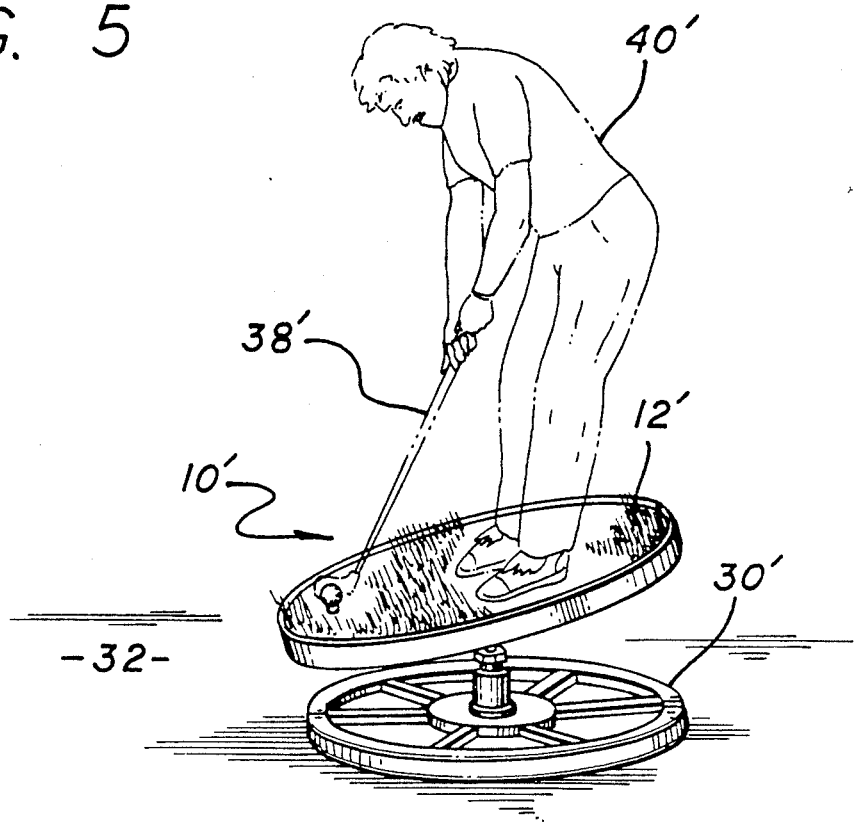
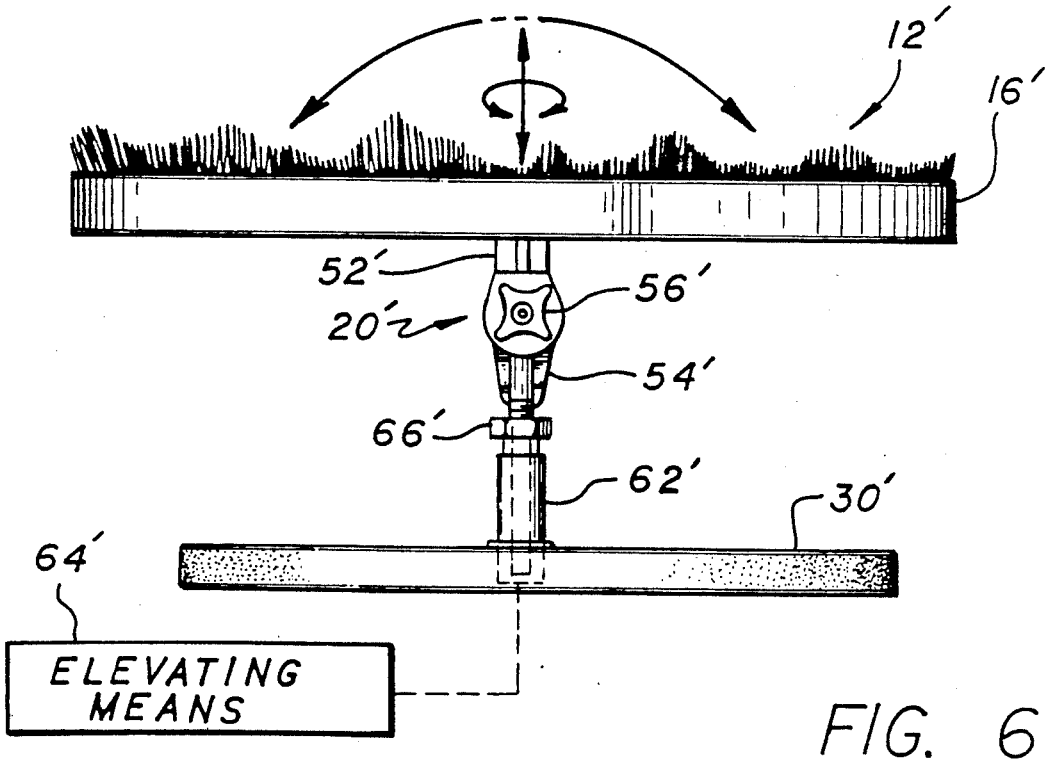
FIG. 6

FIG. 9
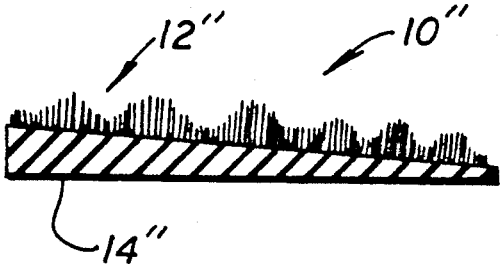
FIG. 8
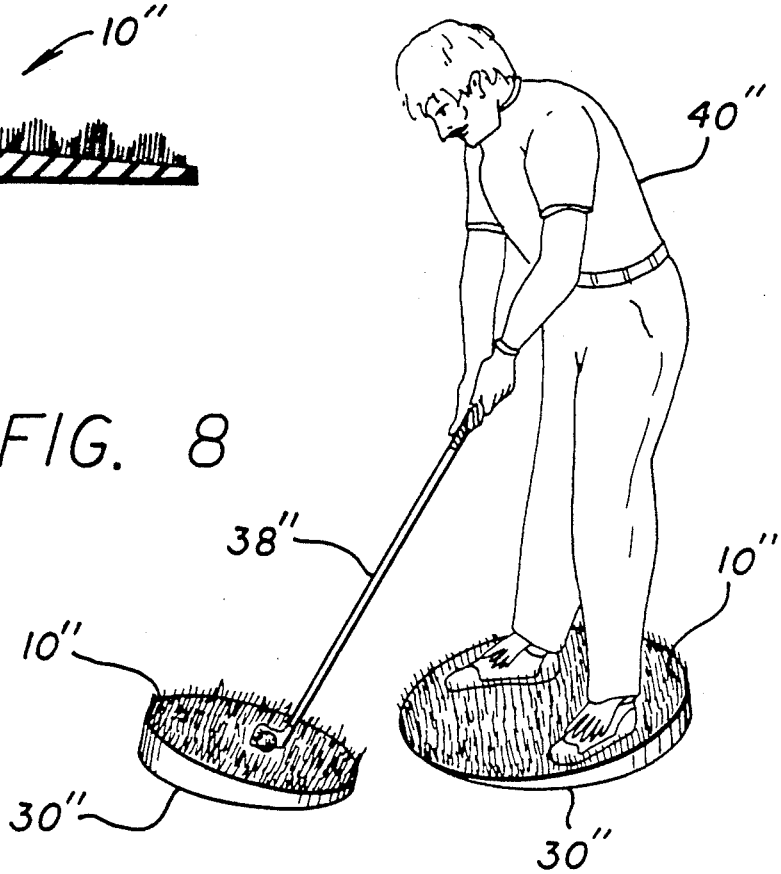
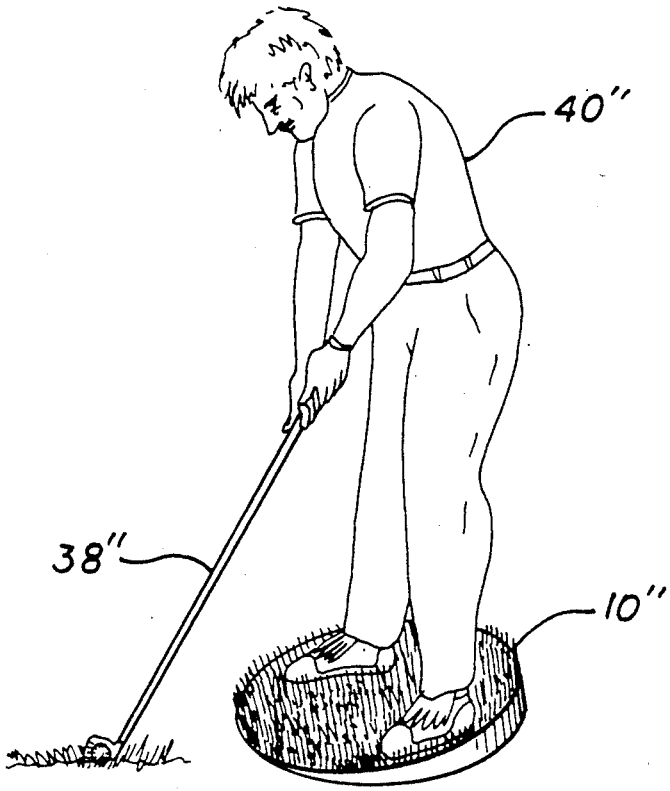
FIG. 10

GOLF MAT

BACKGROUND OF THE INVENTION

1. Field of the Invention

The present invention relates to athletic equipment. More specifically, the present invention relates to mats for practicing golf strokes.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

2. Description of the Related Art

Those who have played the game of golf can appreciate the difficulty and challenge associated with the sport. A precise swing is required on each stroke to achieve the lowest possible score. Yet a precise stroke is difficult to achieve without a considerable amount of practice. Hence, practice ranges have been set up to allow one to develop and hone the skills required for the game.

A typical range provides a number of stalls, one for each practitioner. The stalls are open to the range and separated by walls or nets to protect those in adjacent stalls. Each stall also typically includes a mat on which the golf ball is placed. Conventional mats serve primarily to retain the ball in a fixed position and secondarily to protect the golfer's club against impact against the floor of the stall.

As mentioned above, the development of a precise golf swing requires a considerable amount of practice. Ideally, the golfer will practice the swing under conditions which approximate those to be encountered on the course. For example, on the course, the golfer may have a lie on an incline or a decline. The golfer may be standing on an angle which differs from that on which the ball lies. And the turf around the ball may be uneven, to name a few of the conditions which the golfer may encounter.

While the conventional golf mat enjoys widespread use, it does not simulate the playing conditions the golfer is likely to encounter on the course. That is, the conventional mat lies flat on the ground and has an even contour on the playing surface thereof. No provision is may for incline and decline lies and uneven playing surfaces.

Hence, a need exists in the art for an improved golf mat which simulates the playing conditions a golfer is likely to encounter on the course.

SUMMARY OF THE INVENTION

The need in the art is addressed by the golf mat of the present invention which includes a playing surface which is supported at a nonzero angle with respect to the ground.

In specific embodiments, the playing surface includes artificial turf with an irregular contour. A tee is provided so that the mat may also be used in the traditional (flat) manner. The tee is not used when the mat is angled. The support of the playing surface is provided by a base which lies on the ground and a pivotal supporting apparatus supported by said base and attached to the playing surface. The pivotal supporting apparatus may be adapted for rotary engagement with the base, adapted for maintaining the playing surface in a fixed nonzero angle with respect to the base, and/or adapted for adjusting the elevation between the base and the playing surface.

BRIEF DESCRIPTION OF THE DRAWINGS

FIG. 1 is a diagram of a first illustrative embodiment of the golf mat of the present invention.

FIG. 2 is a side elevational view, partially in section, of the first illustrative embodiment of the golf mat of the present invention.

FIG. 3 is rear elevational view of the first illustrative embodiment of the golf mat of the present invention.

FIG. 4 is a bottom view of the first illustrative embodiment of the golf mat of the present invention.

FIG. 5 is a diagram of a second illustrative embodiment of the golf mat of the present invention.

FIG. 6 is a side elevational view of the second illustrative embodiment of the golf mat of the present invention.

FIG. 8 is a diagram of a third illustrative embodiment of the golf mat of the present invention with a golfer standing on one mat addressing a ball on another mat.

FIG. 9 is a side elevational view of the third illustrative embodiment of the golf mat of the present invention.

FIG. 10 shows a golfer standing on a mat constructed in accordance with the present teachings addressing a ball on the ground.

DESCRIPTION OF THE INVENTION

Figure 7:
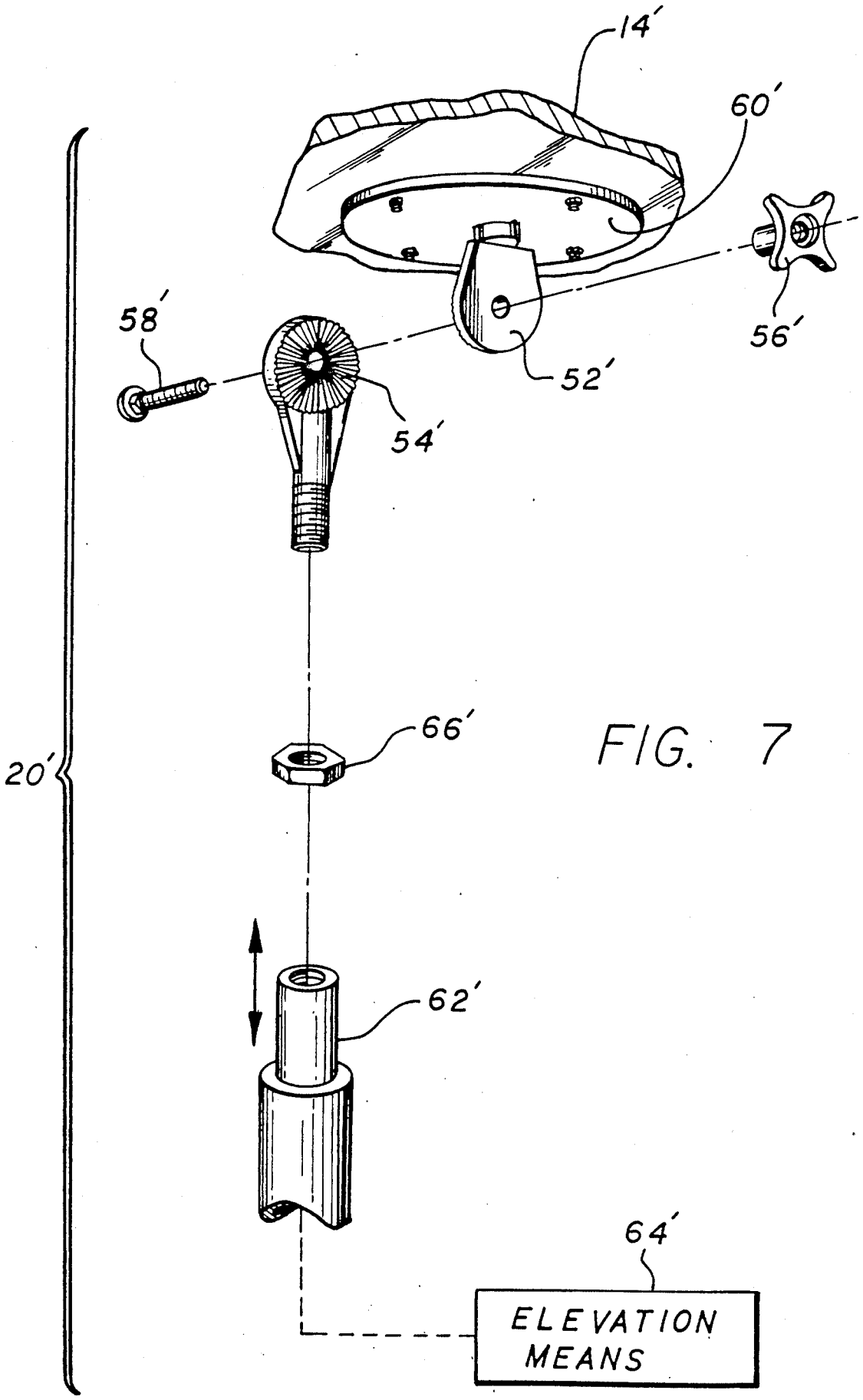
FIG. 7 is a side elevational view of the support mechanism of the second illustrative embodiment of the golf mat of the present invention in disassembled relation.

Illustrative embodiments and exemplary applications will now be described with reference to the accompanying drawings to disclose the advantageous teachings of the present invention.

FIG. 1 is a diagram of a first illustrative embodiment of the golf mat 10 of the present invention. The golf mat 10 includes a playing surface 12 of artificial turf, nylon, olefin or other suitable material. As shown more clearly in the sectional side view of FIG. 2, the playing surface may be supported on a wooden or plastic platform. A plastic molding 16 may be provided about the periphery of the platform 14 for esthetic purposes. Note the irregular surface contour of the playing surface 12 provided by the gradually varying lengths of the groups of individual fibers of artificial turf 18 which make up the playing surface 12.

The platform 14 is supported by a mechanism 20. The support mechanism 20 of the first illustrative embodiment of FIG. 1 is essentially a conventional swivel mechanism. As such, the support mechanism 20 is effective to support the playing surface 12 in the position shown in FIG. 2, the position shown in phantom, or any position therebetween. As shown in the rear view of FIG. 3, the support mechanism 20 includes a rotor 22, which is bolted to the undersurface of the platform 14, and a stator 24 secured to a platter 26. The rotor 22 and stator 24 are coupled via a conventional bearing arrangement (not shown) to permit a swivel motion therebetween about a longitudinal axis 28 therethrough. The platter 26 is suspended on a second set of bearings (also not shown) which permit the platter 26 to rotate about an axis 29 extending through a supporting base 30 as illustrated in the bottom view of FIG. 4. The base 30 is adapted to rest on or in parallel with the ground 32.

As shown in FIG. 2, a hollow cylindrical tube is fixed on the playing surface 12 to provide a tee 34 for a golf ball 36.

As shown in FIG. 1, the first illustrative embodiment of the golf mat 10 is designed to allow a golfer 40 (shown in phantom) to stand on the ground or other level surface while practicing a stroke on an angle. However, where it is desirable to practice a stroke on the same inclined or declined surface on which the ball 42 rests, the second illustrative embodiment of the golf mat 10' of FIG. 5 is preferred. The second embodiment 10' is essentially identical to the first with the exception that the second embodiment is of a much more sturdy construction to support the weight of the golfer 40'. Accordingly, the playing surface 12' and the base 30' are much larger and constructed of aluminum or other suitably strong material.

The most significant difference between the first and second embodiments is the support mechanism 20' illustrated in the elevated side view of FIG. 6 and the disassembled view of FIG. 7. As shown in FIG. 7, the support mechanism 20' includes an interlocking gear arrangement of teeth provided in mating flanges 52' and 54'. The interlocking flanges 52' and 54' are secured together by a large nut 56' and bolt 58' which extends through apertures in the flanges. The first flange 52' is bolted to the platform 14' via a plate 60'. The second flange 54' is secured to the base 30' via a threaded cylindrical extension 62' which is secured to the base 30' via optional elevation means for adjusting the height of the mat 10'. A nut 66' is provided to allow for control of the rotary position of the mat 10'.

FIG. 8 is a diagram of a third illustrative embodiment of the golf mat of the present invention with a golfer standing on one mat addressing a ball on another mat. The mat 10'' of FIG. 8 provides an inexpensive design for applications in which a single angle of incline or decline is sufficient. As shown in the sectional side view of FIG. 9, the mat 10'' includes a wedge shaped grating 14'' of foam (polyurethane) or other suitable material onto which a carpet of olefin or other suitable material is glued or baked to provide the playing surface 12'' having an irregular contour, as in the first embodiment. The grating 14'' of the mat 10'' provides the platform 14'' and the base 30'' of the first and second embodiments and hence a mat of one-piece construction. The mat 10'' may be any size and at any angle. In the preferred embodiment, the mat 10'' is a circular wedge with a 30'' diameter, a ¼'' thickness at the narrow end and a 3'' thickness at the thick end. FIG. 10 shows a golfer standing on a mat constructed in accordance with the present teachings addressing a ball on the ground. Different slopes are achieved by manually rotating the mat position. A golfer might also want to stand on the mat while practicing from a traditional flat mat.

Thus, the present invention has been described herein with reference to a particular embodiment for a particular application. Those having ordinary skill in the art and access to the present teachings will recognize additional modifications applications and embodiments within the scope thereof.

It is therefore intended by the appended claims to cover any and all such applications, modifications and embodiments within the scope of the present invention.

Accordingly,

What is claimed is:

1. A golf mat comprising:

a wedge-shaped base of polyurethane foam having a circular configuration approximately thirty inches in diameter and being approximately one-quarter inch thick at a first narrow end thereof and approximately three inches thick at a second diametrically opposite end thereof;

a layer of artificial turf of irregular contour disposed on said wedge-shaped base; and means for retaining said layer of artificial turf on said wedge-shaped base.

* * * * *